US007044123B2

(12) United States Patent
Rigamonti

(10) Patent No.: US 7,044,123 B2
(45) Date of Patent: May 16, 2006

(54) HIGHLY EFFICIENT HEAT EXCHANGER AND COMBUSTION CHAMBER ASSEMBLY FOR BOILERS AND HEATED AIR GENERATORS

(76) Inventor: Angelo Rigamonti, Via Provincials, 85, 20060 Pessano con Bornago (IT)

( * ) Notice: Subject to any disclaimer, the term of this patent is extended or adjusted under 35 U.S.C. 154(b) by 109 days.

(21) Appl. No.: 10/386,041

(22) Filed: Mar. 11, 2003

(65) Prior Publication Data

US 2004/0069295 A1 Apr. 15, 2004

(30) Foreign Application Priority Data

Oct. 12, 2002 (IT) ..... MI20020573 U

(51) Int. Cl.
*F24H 3/08* (2006.01)

(52) U.S. Cl. ..... 126/109; 126/104 R; 165/147; 165/177

(58) Field of Classification Search ..... 126/109, 126/104 R; 165/147, 177; 138/38
See application file for complete search history.

(56) References Cited

U.S. PATENT DOCUMENTS 601,590 A * 3/1898 Rossman ..... 126/61
2,466,684 A * 4/1949 Case ..... 165/148
2,653,799 A * 9/1953 Stahn et al. ..... 165/83
2,800,126 A * 7/1957 Costello et al. ..... 126/110 B
2,979,050 A * 4/1961 Costello ..... 126/104 R

FOREIGN PATENT DOCUMENTS

EP 0 570 642 * 10/1992
GB 2 091 868 * 1/1982
WO WO 91/02195 * 7/1990

* cited by examiner

*Primary Examiner*—Alfred Basichas
(74) *Attorney, Agent, or Firm*—Hedman & Costigan, P.C.

(57) ABSTRACT

The present invention relates to a heat exchanger and condensation combustion chamber assembly, comprising a plurality of tubes and including a front plate and a rear plate connected to the combustion chamber with a drop pattern.

Each of the heat exchanger tubes comprises a variable area cross section, with a flat portion at a middle region, to provide a larger thermal exchange surface.

The middle region is subjected to a crossed cut molding process to provide a helical type of fume path, suitable to enhance the efficiency of the assembly, owing to an increased thermal exchange between the fumes and heated air flows.

The combustion chamber having a cross section of drop shape allows to properly solve the problem related to the very high temperatures generated by recent cylindrical gas burners having a metal mesh surface generating great amounts of heat, which must be disposed of in a thermal exchange process with the heated air flow.

3 Claims, 4 Drawing Sheets

HIGHLY EFFICIENT HEAT EXCHANGER AND COMBUSTION CHAMBER ASSEMBLY FOR BOILERS AND HEATED AIR GENERATORS

BACKGROUND OF THE INVENTION

The present invention relates to a heat exchanger and a condensation combustion chamber assembly for the passage of the fumes generated by air/gas combustion, produced by a pre-mixed burners coupled to the combustion chamber.

Such an assembly, as is known, has a very high efficiency, of the order of 105% and generates, as combustion products, in addition to the combustion fumes, also water steam, which is conveyed to the outside environment, through a dedicated conveying duct.

In such an embodiment, it is necessary to increase or enhance the thermal exchange between the fumes and secondary air to be heated, while preventing any generations of laminar flows with thermal gradients inside the exchanging tube, which would cause a decrease of the thermal exchange with the secondary fluid.

A further problem is that of the high heating of the combustion chamber, operating in cooperation with pre-mixed gas burners having a very high unit power for flame surface.

The first problem, related to the increase of the thermal exchange in the heat exchanger tubes, has been solved by providing "turbulating" devices, inside said heat exchanger tubes.

The above mentioned devices, made of stainless steel and having a rectangular cross-section blade configuration, deformed in the form of a spiral helix, were designed for generating a turbulent motion in the hot fume path, to prevent any laminar effect from occurring, with a consequent decreasing of the heat amount being exchanged.

SUMMARY OF THE INVENTION

Accordingly, the aim of the present invention is to solve the above mentioned problems.

Within the scope of the above mentioned aim, a main object of the present invention is to provide such a heat exchanger, of the tube sheet and combustion chamber type, allowing to fit high thermal loads, with a comparatively small exchange size, and allowing, moreover, to hold a turbulent motion of the combustion fumes, without generating negative load losses through the system.

According to one aspect of the present invention, the above mentioned aim and objects, as well as yet other objects, which will become more apparent hereinafter, are achieved by a heat exchanger and combustion chamber assembly, specifically designed for burners and heated air generators, characterized in that the heat exchanger comprises a plurality of tubes connected to one another and to said combustion chamber by a front plate and a rear plate, for compensating for the loss of the volumes and the temperature of the fumes and for holding the fume rate substantially constant.

BRIEF DESCRIPTION OF THE DRAWINGS

Further characteristics and advantages of the present invention will become more apparent hereinafter from the following detailed disclosures of a preferred, though not exclusive, embodiment of the invention, which is illustrated, by way of an indicative, but not limitative, example, in the accompanying drawings, where.

DESCRIPTION OF THE PREFERRED EMBODIMENTS

Figure 1:
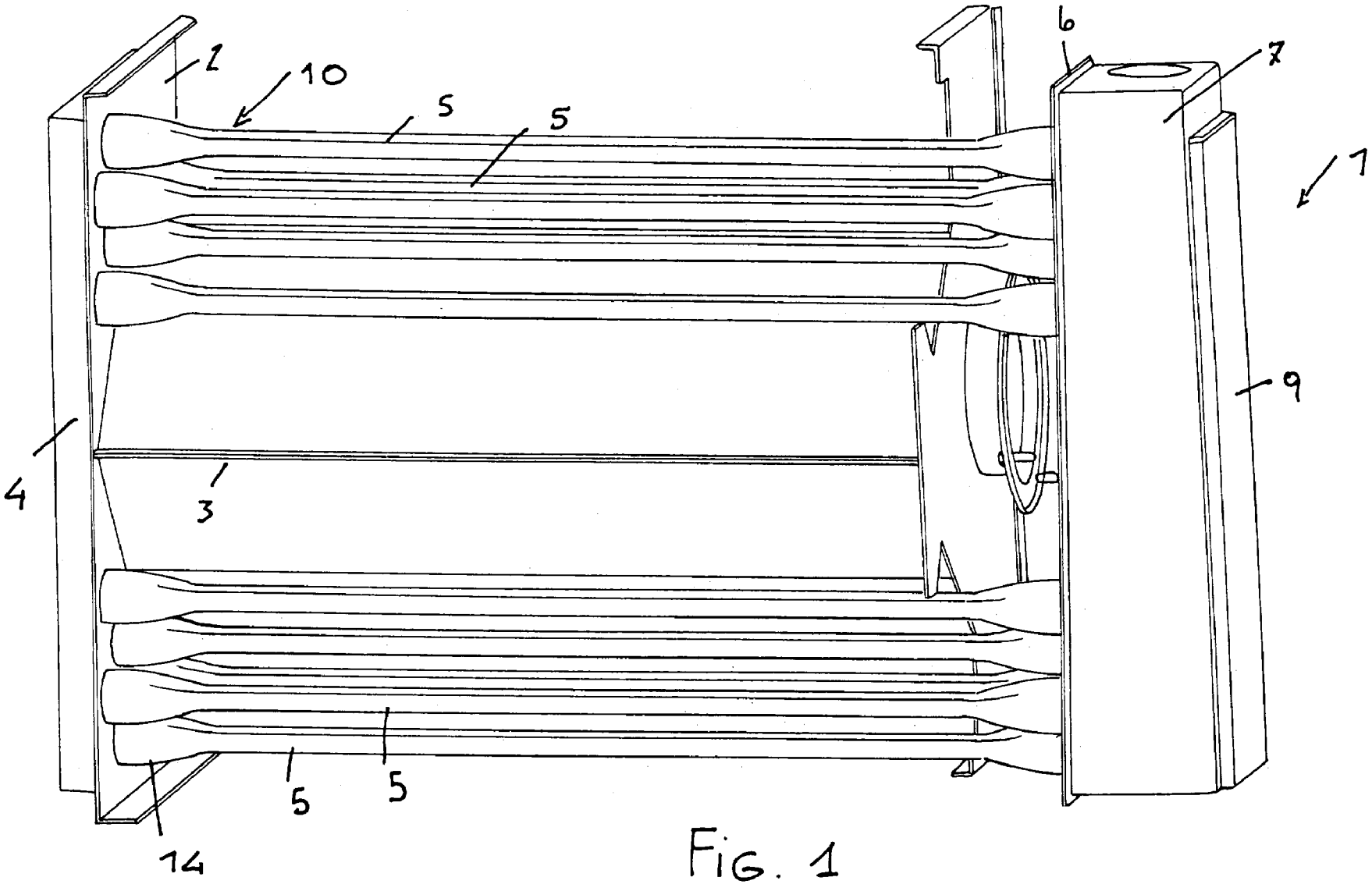
FIG. 1 is a side perspective view of the heat exchanger and combustion chamber assembly according to the present invention.
Figure 2:
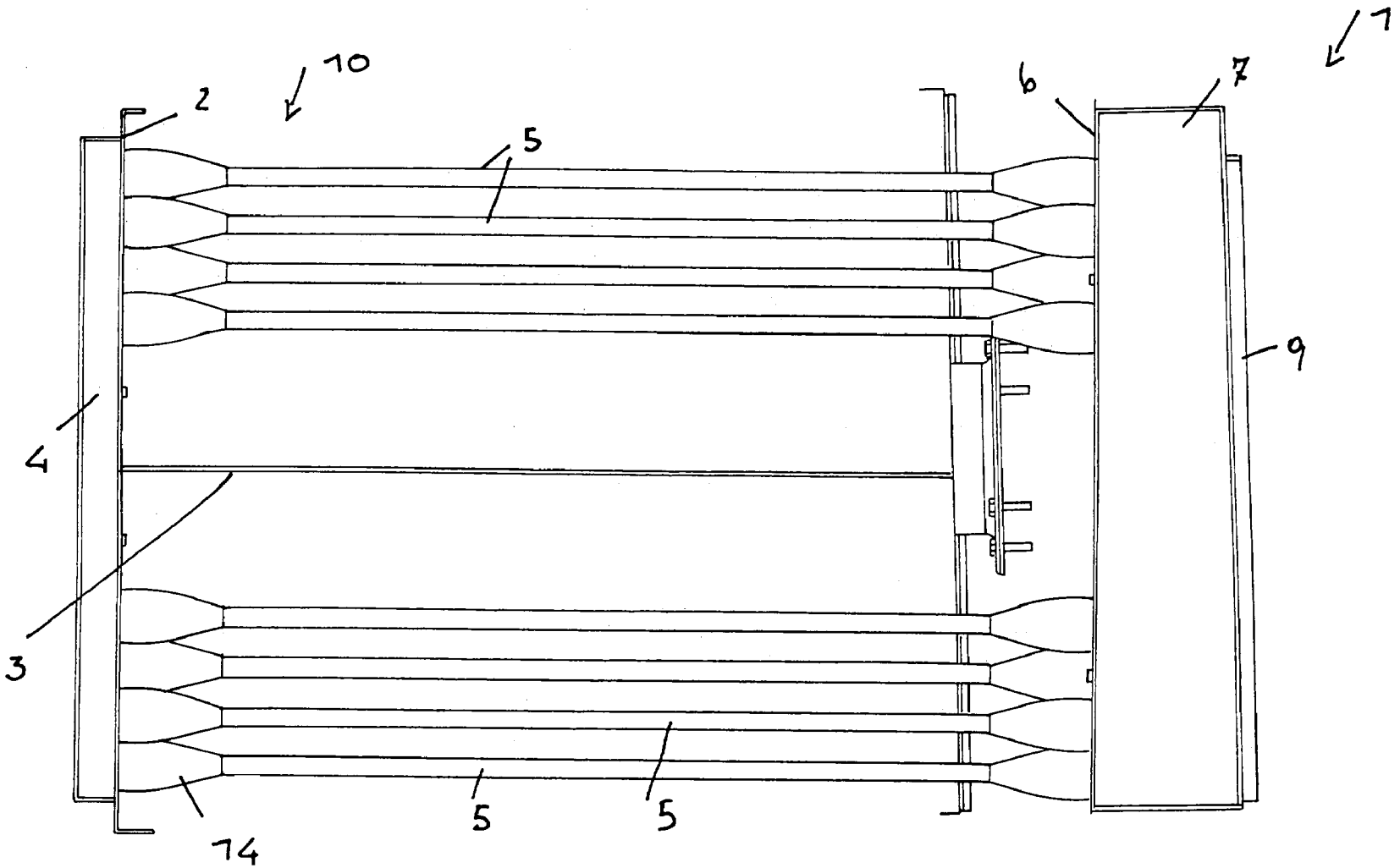
FIG. 2 is a side view of that same heat exchanger and combustion chamber assembly.
Figure 3:
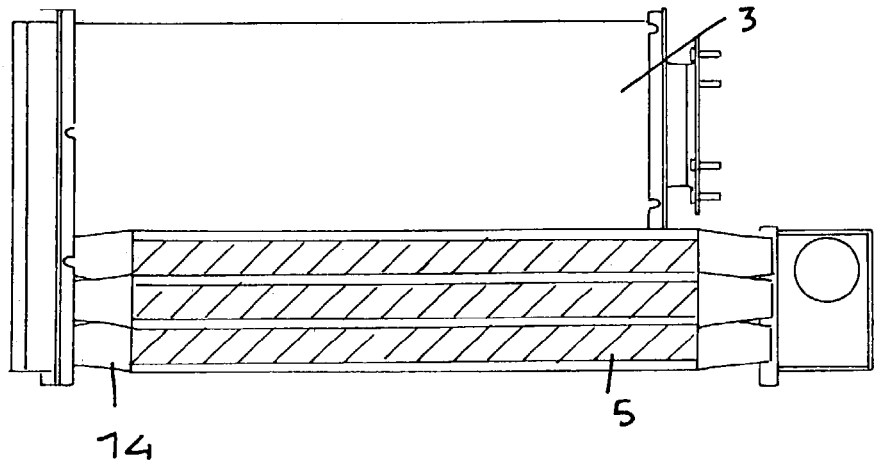
FIG. 3 is a top plan view of the heat exchanger assembly and combustion chamber according to the present invention.

With reference to the number references of the above mentioned figures, the assembly according to the present invention, which has been generally indicated by the reference number 1, comprises a combustion chamber 3, associated with a heat exchanger, generally indicated by the reference number 10, which essentially comprises a plurality of heat exchanger tubes 5, the ends of which are coupled to a rear tube plate or sheet 2 and a front tube plate or sheet 6.

The rear tube plate 2, in particular, is coupled to a rear manifold 4.

According to a main feature of the present invention, each tube 5 has, starting from the front plate 6 to the rear plate 2, a gradually tapering or reducing cross-section.

Figure 4:
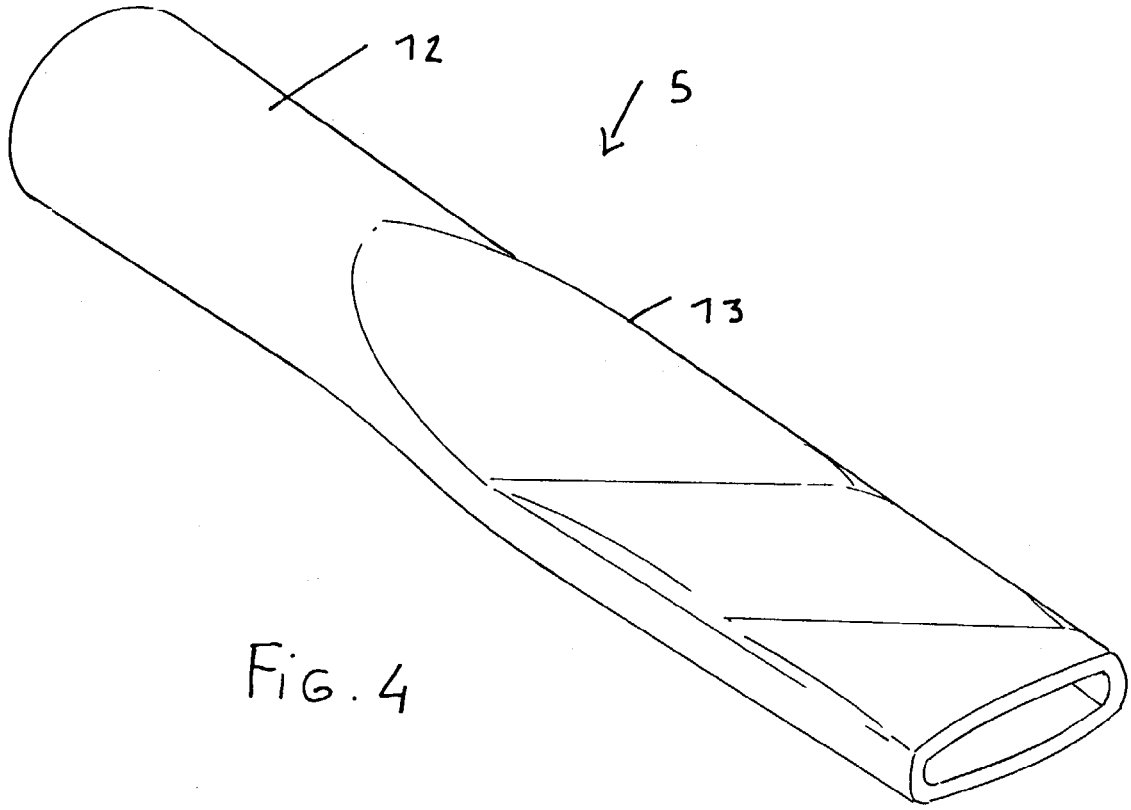
FIG. 4 is a perspective view of a length of a heat exchanger tube.

More specifically, the tubes 5 have a front attachment portion 12 (FIG. 4) having a circular cross-section and comprising a portion or length 13 where the cross-section is narrowed to an elliptical configuration.

On this section a deforming operation is carried out, which can be defined as a cross deforming operation, allowing to generate a fume tubulating type of fume path, thereby increasing the thermal exchange between the hot fumes coming from the combustion chamber and heated air.

The heat exchanger tube 5, at the end region 14 thereof, returns to a circular configuration, thereby facilitating the coupling to the rear plate, for example by a welding operation.

The shape or configuration of said tubes is variable, depending on the requirements, and the exchanger tube cross section must be so designed as to compensate for the volume loss and fume temperature, so as to practically hold a constant fume rate, thereby providing an inner "turbulating" motion, effective to improve the efficiency of the assembly.

In particular the flattening-out of the tube sheet assembly allows, in addition to providing the above disclosed advantages, to properly hold the fluid rates, and provide a secondary conveying element, thereby enhancing the thermal exchange properties.

Figure 5:
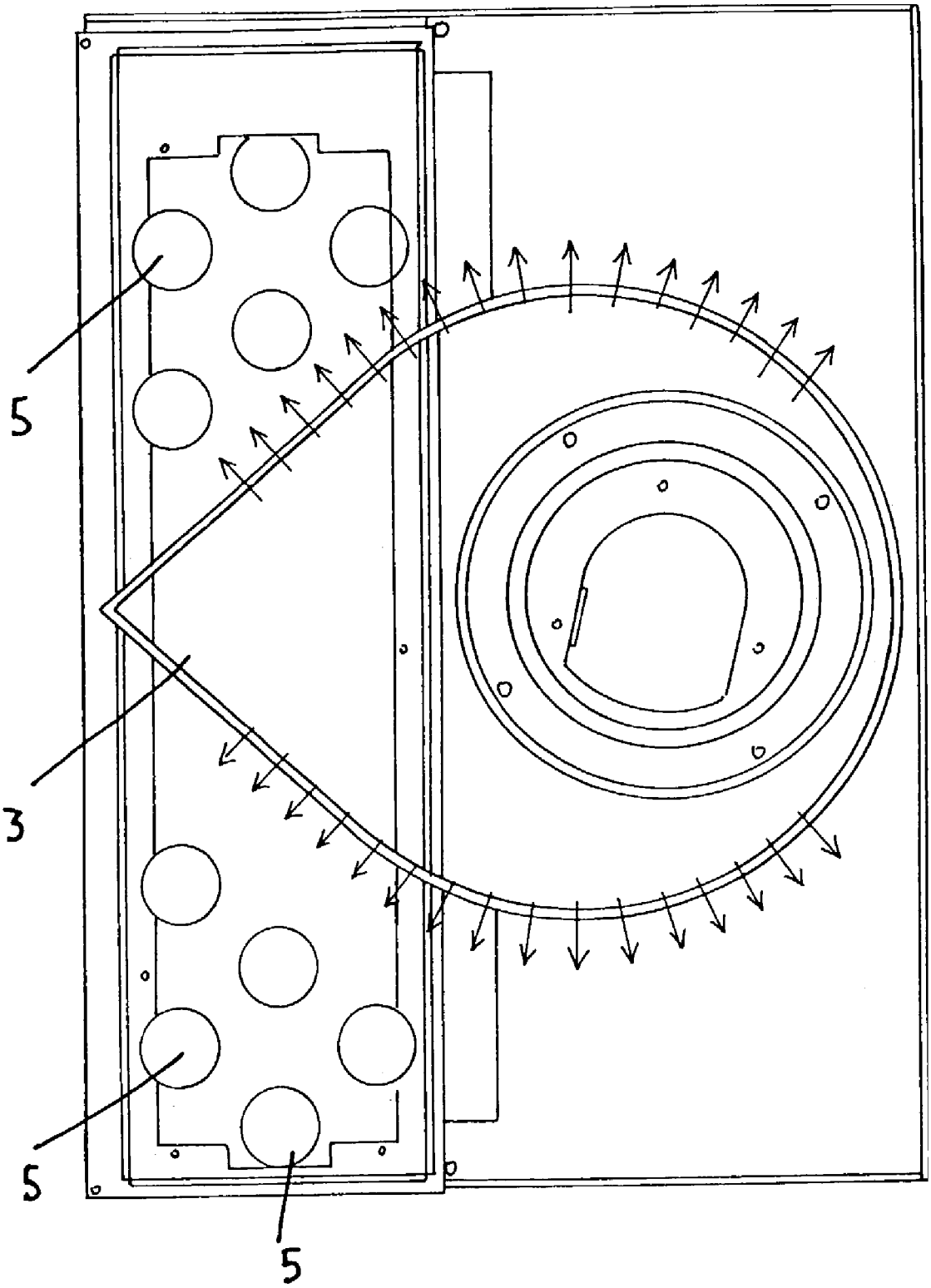
FIG. 5 is a front elevation view of the heat exchanger and combustion chamber assembly according to the invention.

A main feature of the combustion chamber 3, is that the cross-section thereof has a drop configuration, as clearly shown in FIG. 5.

This technical approach, would allow to use a high power cylindric burner to be arranged in an offset position in said combustion chamber 1 (as shown in FIG. 5), while providing a laminar motion of the cooling air an on the exchanger, in turn allowing to provide and even cooling, and consequently a long duration of the heat exchanger.

It has been found that the invention fully achieves the intended aim and objects.

In fact, the invention has provided a tube sheet heat exchanger having a combustion chamber which can be fitted to high thermal load, with a comparatively reduced exchange size.

Moreover, the subject heat exchanger provides the combustion fumes with a turbulent motion, without generating undesired load losses through the system.

Furthermore, the tube sheet allows to design the exchanging tubes depending on the exchanger power, thereby using the tube sheet as a secondary fluid conveyor.

The heat exchanger and combustion chamber provide a very reliable and safe operation, while using commercially available elements, and with a very low economic operation cost.

In particular, the heat exchanger according to the invention allows to always maintain a great turbulence of the combustion fumes, without any important load losses, thereby properly solving the thermal exchange problem.

The combustion chamber allows to use an inner high power burner, thereby providing, owing to the offset location of the burner and the chamber drop configuration, a long duration of the exchanger and combustion chamber itself.

In practicing the invention, the used materials, as well as the contingent size and shapes, can be any, depending on requirements and the status of the art.

The invention claimed is:

1. A heat exchanger and combustion chamber assembly for burners and heated air generators, comprising a plurality of tubes for conveying combustion fumes therethrough, said tubes being connected to one another and to said combustion chamber by a front plate and a rear plate, wherein said tubes have, at said front plate, a front welding portion having a circular cross-section, said front welding portion being followed by a narrowing elliptical cross-section portion followed by a flat cross-section portion in turn followed by a circular cross-section end attachment portion to be welded to said rear plate, and wherein said flat crosssection portion has a mechanically deformed cross surface, allowing to generate a fume turbulating fume path, thereby increasing a thermal exchange between hot fumes coming from said combustion chamber and heated air.

2. A heat exchanger and combustion chamber assembly, according to claim 1, said fume generating combustion chamber having a drop configuration, wherein an offset burner is housed in an offset position in said combustion chamber.

3. A heat exchanger and combustion chamber assembly, according to claim 1, wherein said tubes are adapted to also convey a thermal exchange secondary fluid.

* * * * *